United States Patent [19]

Mahaffy

[11] Patent Number: 4,799,723

[45] Date of Patent: Jan. 24, 1989

[54] TWIN CUP CARRIER

[75] Inventor: John W. Mahaffy, Crystal Lake, Ill.

[73] Assignee: The Continental Group, Inc., Norwalk, Conn.

[21] Appl. No.: 629,372

[22] Filed: Jul. 10, 1984

Related U.S. Application Data

[63] Continuation-in-part of Ser. No. 169,531, Jul. 17, 1980, abandoned.

[51] Int. Cl.[4] ..... B65D 71/00

[52] U.S. Cl. ..... 294/87.2; 206/150

[58] Field of Search ..... 294/87.2, 31.2; 206/150, 162, 142; 229/1.5 H; 215/100 A

[56] References Cited

U.S. PATENT DOCUMENTS 3,561,594 2/1971 Jorgenson ..... 206/162

3,608,949 10/1971 Owen ..... 294/87.2

*Primary Examiner*—James B. Marbert

*Attorney, Agent, or Firm*—Charles E. Brown; Paul Shapiro; Charles A. Brown

[57] ABSTRACT

This relates to a carrier for cups or containers. The carrier is formed from a flat sheet of plastic material and has a pair of openings therein on opposite sides of a transverse bar for receiving upper intermediate portions of cups. Each of the openings is defined by a peripheral strap which will tightly engage an intermediate upper portion of a vertically tapered cup. Further, generally surrounding at least one of the openings is a carrying strap defined by a C-shaped cut which also defines the article engaging strap for that opening. In one form of carrier there are two carrying straps and in another form there is a single carrying strap.

14 Claims, 2 Drawing Sheets

TWIN CUP CARRIER

This application is a continuation-in-part of my earlier filed copending application Ser. No. 169,531, filed July 17, 1980, now abandoned.

This invention relates in general to new and useful improvements in carriers, and more particularly to a carrier for carrying twin cups or containers.

In accordance with this invention, the carrier is formed of a thin sheet of flexible material, such as a plastic material. The carrier is particularly adapted to be utilized in carrying simultaneously two like cups or containers which are vertically tapered. In accordance with the invention, the carrier is to be placed on a counter in a flat state, and a cup placed in each of its openings and seated on the counter. Then the strap or strap portions of the carrier are engaged and lifted upwardly above the tops of the containers with the carrier sliding up the containers to an intermediate point at which the periphery of openings formed in the carrier correspond to the periphery of the intermediate portion of the cups at which time the carrier becomes interlocked with the cup and has a stable condition. It is to be understood that the point of engagement of the carrier with the cup or container body is above the mid-height so as to provide a stable relationship.

Carton carriers of this broad type are known, reference being had to the U.S. Pat. No. 3,829,143 to Bird, granted Aug. 13, 1974. However, the carrier of Bird is not only much more complex than the carrier which is the subject of this invention, but also the carrier of Bird primarily intended to be utilized in conjunction with containers or cartons of constant cross section.

Simply stated, the container carrier of this invention is formed from a thin flat sheet of flexible material, preferably a plastic material, in which two openings, separated by a transverse bar, are formed. The openings may be of any configuration although they are preferably of a shape and size to correspond to an upper intermediate portion of the cup for which the carrier is particularly intended. In the preferred embodiment of the invention, the sheet is provided with a pair of C-shaped cuts which are disposed about and generally correspond to the outline of adjacent portions of the openings, thereby defining two straps, one at each end of the sheet, the straps having terminal ends opposing one another. In another form of the invention, a single strap may suffice.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
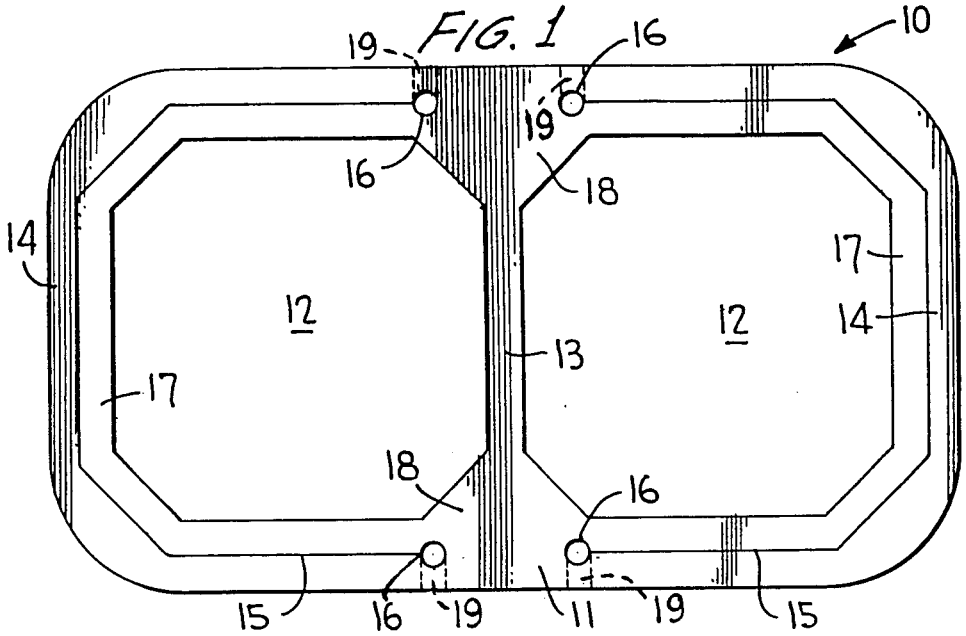
FIG. 1 is a plan view of the cup carrier formed in accordance with this invention, and shows the general outline thereof.

Referring now to the drawings in detail, it will be seen that there is illustrated in FIG. 1 a preferred embodiment of cup carrier, generally identified by the numeral 10. The cup carrier 10 is in the form of a generally rectangular sheet of flexible material, preferably a suitable plastic material. The plastic material sheet is identified by the numeral 11 and has formed therein a pair of like openings 12 separated by a central portion of a transverse bar 13. The illustrated-openings are octagonal with alternating long and short sides and are of an outline and size to engage an upper intermediate portion of a selected cup or container. However, the openings 12 may be of any desired configuration and are preferably of a configuration corresponding to an upper intermediate portion of a cup or container to be engaged by the carrier 10. It is to be understood that the periphery of the openings 12 corresponds to the periphery of the upper intermediate portion of a cup or container which is to be engaged.

The outer periphery of the sheet 11 is in the form of a pair of carrier straps 14 each of which is defined by a single generally C-shaped cut 15 which generally surrounds a respective one of the openings 12 and is of a similar configuration. Each C-shaped cut 15 terminates at its opposite end in holes 16 punched in the sheet 11. The holes 16 prevent the tearing of the sheet 11 at the ends of the cuts 15. The holes 16 also aid in defining hinge areas 19 which define ends of the carrier straps 14 which are in opposed relation on opposite sides of the transverse bar 13. The holes 16, however, may be eliminated.

It is to be noted that the C-shaped cuts 15, together with the openings 12 and the transverse bar 13, define strap portions 17 which are free to conform to the cross section of the cups or containers which are to be carried by the carrier 10.

It is also to be noted that the transverse bar 13 has terminal portions 18 which are relatively wide. The relatively wide portions 18 assure the necessary strength in the sheet 11 in the areas of greatest stress as the load is transferred from the straps 17 to the straps 14 through the terminal portions 18.

From the foregoing it will be seen that each C-shaped cut line 15 and the strap 17 defined thereby have ends which terminate in the terminal portions 18 of the transverse bar 13. It will also be noted that the width of the narrow portion of the transverse bar 13 between the openings 12 approximates the width of the straps 17. Further, the transverse strap 13 extends the full width of the sheet.

Figure 2:
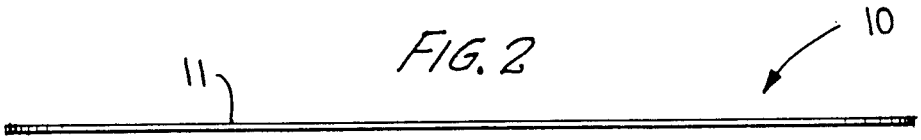
FIG. 2 is a side elevational view of the cup carrier showing it to be of a thin constant cross section.

As is clearly shown in FIG. 2, the sheet 11 is of constant thickness and is relatively thin.

Figure 3:
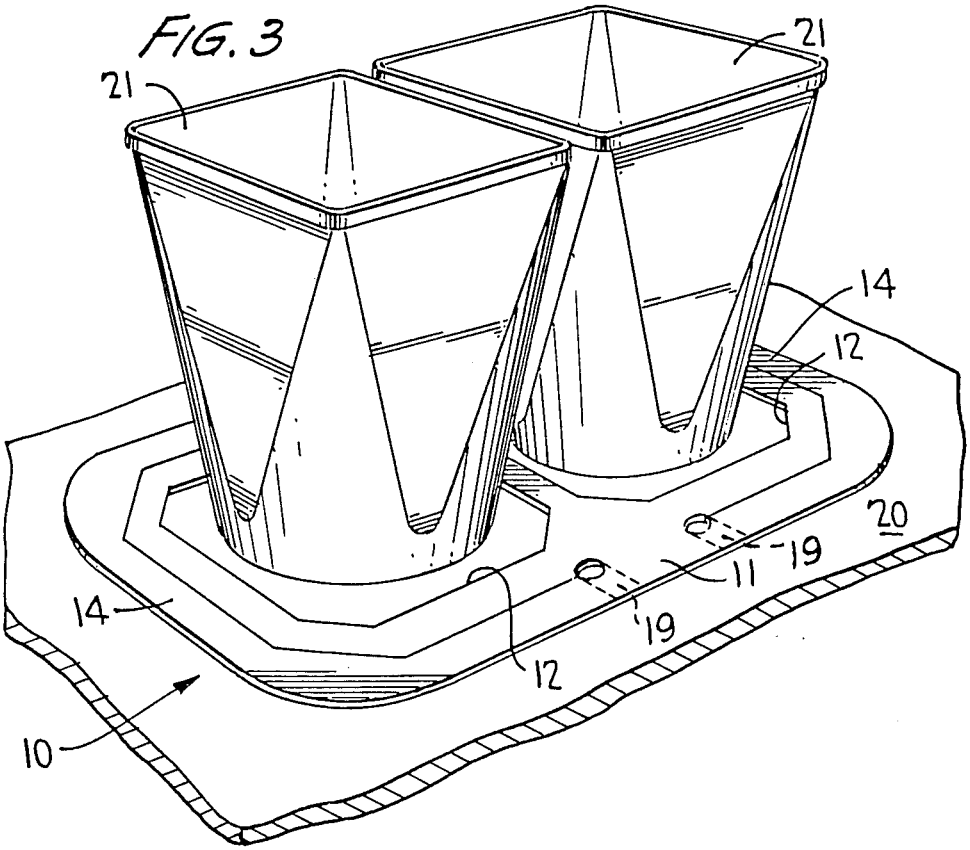
FIG. 3 is a top perspective view showing the cup carrier having two cups to be carried utilizing the same associated therewith.
Figure 4:
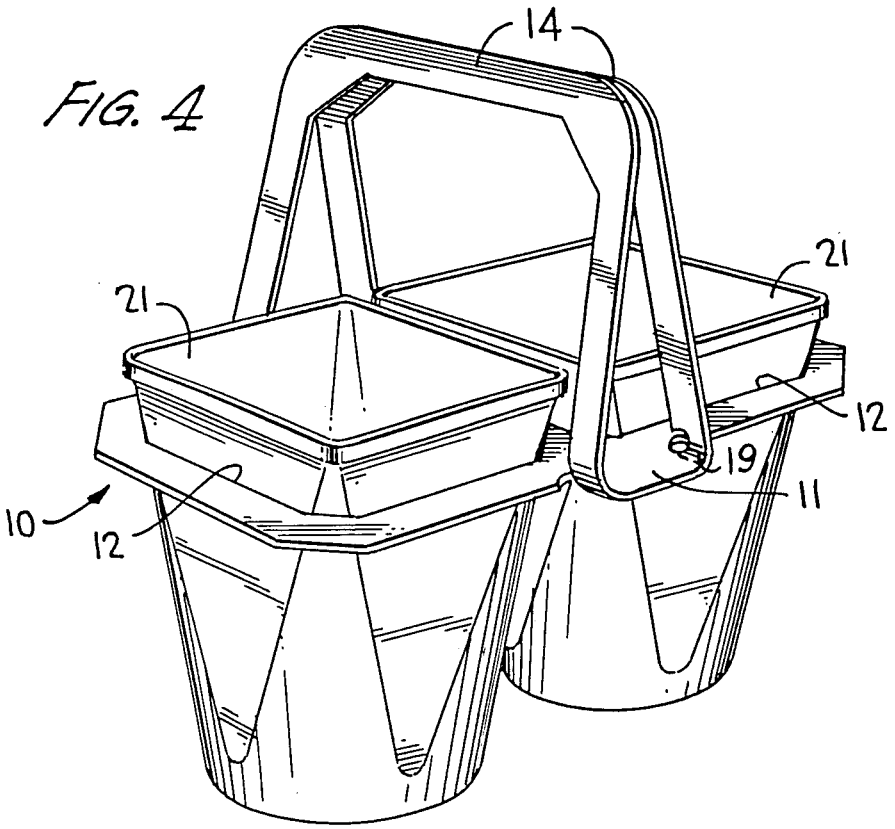
FIG. 4 is a top perspective view similar to FIG. 3, but shows, the carrier lifted and in cup supporting relation.

Referring now to FIG. 3, it will be seen that in use the carrier 10 is placed upon a suitable support such as a counter 20 and the tapered cups or containers 21 which are to be carried by the carrier 10 are seated on the counter within the openings 12 in the carrier. With the cups or containers 21 so positioned, the straps 14 are engaged and moved upwardly with the result that the entire sheet 11 generally moves upwardly until the cups or containers 21 begin to fill the openings 12. When the periphery of the openings 12 corresponds to the external periphery of the cups or containers 21, the carrier 10 becomes snugly interlocked with the containers and the carrier now may be utilized to transport the containers in a conventional manner. Inasmuch as the carrier 10 e gages the upper portions of the cups, there is no danger of spillage.

Figure 5:
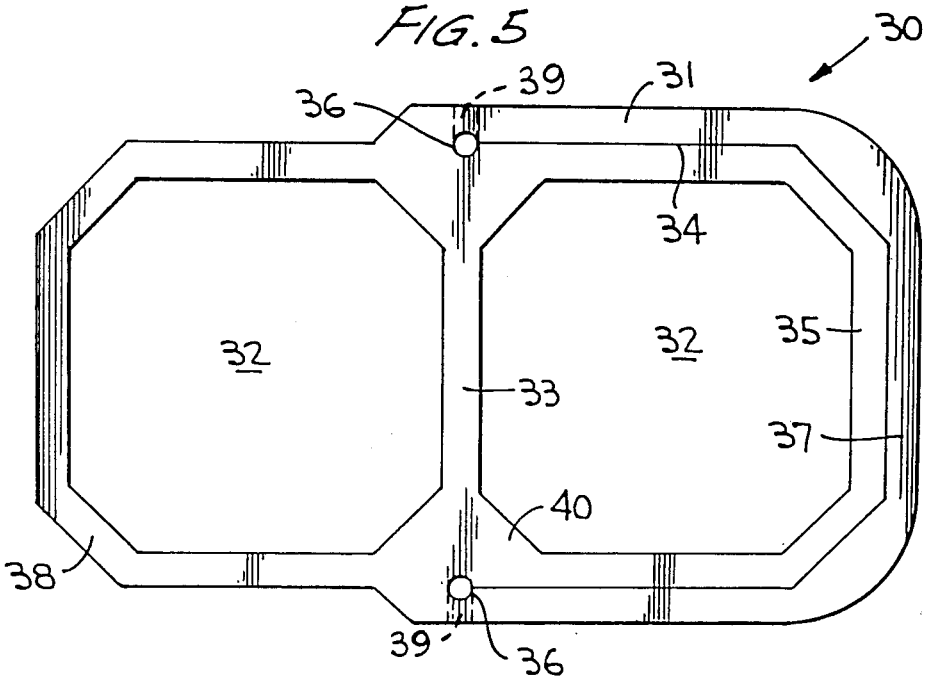
FIG. 5 is a plan view of a modified form of cup carrier.

Referring now to FIG. 5, it will be seen that there is illustrated a slightly modified form of cup carrier, the carrier being generally identified by the numeral 30 and being formed of a thin sheet 31 of flexible material. This material is also preferably a plastic material.

The sheet 31 is generally rectangular, but generally is of a slightly different configuration from the sheet 11. The sheet 31 has formed therein a pair of like openings 32 which are separated by a central portion of a transverse bar 33.

One-half of the sheet 31 is provided with a single generally C-shaped cut 34 which extends about the respective opening 32 so as to define a strap 35. The C-shaped cut 34 terminates at its opposite end in openings 36 so as to prevent tearing of the sheet 31. It will be readily apparent that the single C-shaped cut 34 defines a carrying strap 37 which substantially surrounds the one opening 32. The openings 36 aid in defining hinge areas 39 which define opposite ends of the strap 37.

The sheet 31 at the opposite end thereof is also configurated to define a cup engaging strap 38 which corresponds to the strap 35.

It is to be noted that the carrier 30 differs from the carrier 10 not only in that it is provided with a single carrying strap 37, but also that the strap 37 terminates in transverse alignment with the center of the transverse bar 33. On the other hand, the sheet 31 is configurated so as to have terminal portions 40 of the transverse bar 33 at opposite ends of the central portion of the transverse bar 33 which are of greater width than other portions of the sheet so as to provide maximum strength in the sheet at the point where the carrying strap 37 joins the article retaining straps 35, 38.

Like the transverse bar 13, the transverse bar 33 extends the full width of the sheet with the ends of the cut line 34 and the strap 37 terminating at the terminal portions 40 of the transverse bar 33. Further, the narrow portion of the transverse bar 33 is of a width generally approximating the width of the straps 35.

It is to be understood that the carrier 30 is to be utilized in the same manner as the carrier 10, and no further description of its operation is being set forth here.

Although only two preferred forms of carrier constructions have been specifically illustrated and described, it is to be understood that minor variations may be made in the carrier without departing from the spirit and scope of the invention as defined by the appended claims.

I claim:

1. A carton carrier for a pair of tapered cartons, said carton carrier comprising a thin sheet of flat flexible material, said sheet having a greater length than width dimension, a pair of like carton receiving openings in said sheet separated by a relatively narrow portion of a transverse bar, and at least one C-shaped carrier strap defined by a single generally C-shaped cut line in said sheet partially around a respective one of said carton receiving openings and terminating at opposite ends of said transverse bar, said carrier strap having ends also terminating at opposite ends of said transverse bar at the ends of said single C-shaped cut line, said strap ends each being directly integrally joined to said transverse bar and having a transverse hinge area extending generally parallel to said transverse bar.

2. A carton carrier according to claim 1 wherein said single generally C-shaped cut is of a configuration corresponding to adjacent portions of said respective carton receiving opening and said respective opening is primarily defined by a band of substantially uniform width defined by said single generally C-shaped cut line.

3. A carton carrier according to claim 2 wherein said carrier strap terminates in enlarged terminal portions of said transverse bar, said enlarged terminal portions being of material width.

4. A carton carrier according to claim 1 wherein said carrier is intended for use with cartons tapering in cross section in an upward direction and the periphery of each of said openings corresponding to the periphery of an intermediate part of the intended carton.

5. A carton carrier according to claim 1 in combination with two cartons each tapering in cross section in an upward direction, said cartons extending through said openings, and those portions of said sheet defining the peripheries of said openings snugly interlocking with intermediate portions of said cartons having substantially like peripheries.

6. A carton carrier according to claim 1 wherein there are two of said carrier straps each defined by a single generally C-shaped line cut in said sheet around a separate one of said openings, and ends of said carrier straps terminating in longitudinally spaced opposed relation.

7. A carton carrier according to claim 1 wherein there are two of said carrier straps each defined by a single generally C-shaped lint cut in said sheet around a separate one of said openings, and ends of said carrier straps terminating in longitudinally spaced opposed relation on opposite sides of said transverse bar.

8. A carton carrier according to claim 7 wherein said transverse bar terminates at its end in terminal portions of greater width than central portions of said transverse bar, and said strap ends are integrally joined directly to said greater width terminal portions of said transverse bar.

9. A carton carrier according to claim 1 wherein said transverse bar extends the full width of said sheet.

10. A carton carrier according to claim 2 wherein said transverse bar extends the full width of said sheet.

11. A carton carrier according to claim 2 wherein said relatively narrow portion of said transverse bar is of a width generally approximating the width of said band of substantially uniform width.

12. A carton carrier according to claim 1 wherein said single C-shaped cut line terminates in terminal openings, and with the exception of cuts defining the periphery of said sheet, said terminal openings and said carton receiving openings, said single C-shaped cut line forms the only cut in said sheet.

13. A carton carrier according to claim 1 wherein with the exception of cuts defining the periphery of said sheet and said carton receiving openings, said single C-shaped cut line forms the only cut in said sheet.

14. A carton carrier according to claim 7 wherein with the exception of cuts defining the periphery of said sheet and said carton receiving openings, said C-shaped cut lines form the only cuts in said sheet.

* * * * *